United States Patent [19]

Yamamoto et al.

[11] Patent Number: 4,962,251

[45] Date of Patent: Oct. 9, 1990

[54] PROCESS FOR PRODUCTION OF AROMATIC HYDROCARBONS

[75] Inventors: Takashi Yamamoto; Toshikazu Yoneda; Hisashi Katsuno; Takashi Murakawa; Nobuyuki Takahashi, all of Sodegaura, Japan

[73] Assignee: Research Association for Utilization of Light Oil, Tokyo, Japan

[21] Appl. No.: 462,298

[22] Filed: Dec. 28, 1989

Related U.S. Application Data

[63] Continuation-in-part of Ser. No. 214,522, Jul. 1, 1988, abandoned.

[30] Foreign Application Priority Data

Jul. 30, 1987 [JP] Japan ..... 62-188850
Dec. 19, 1987 [JP] Japan ..... 62-322478

[51] Int. Cl.[5] ..... C07C 2/52
[52] U.S. Cl. ..... 585/419; 208/138
[58] Field of Search ..... 585/419; 208/138

[56] References Cited

U.S. PATENT DOCUMENTS 3,853,745 12/1974 Welty .
4,416,806 11/1983 Bernard et al. ..... 585/419
4,417,083 11/1983 Bernard et al. ..... 585/419
4,634,517 1/1987 Tzuster et al. ..... 208/138
4,648,960 3/1987 Poeppelmeier et al. ..... 208/138
4,648,961 3/1987 Jacobson et al. .

OTHER PUBLICATIONS

English Abstract of Japanese Patent Publication No.: 42639/1981 (marked "A").
English Abstract of Japanese Patent Publication No.: 23368/1983 (marked "B").
English Abstract of Japanese Patent Publication No.: 92717/1978 (marked "C").
English Abstract of Japanese Patent Publication No.: 140934/1981 (marked "D").
English Abstract of Japanese Patent Publication No.: 80333/1984 (marked "E").
"$C_5/C_6$ Isomerization", Hydrocarbon Processing, p. 121, Sep. 1972.
"Hysomer Isomerization", The Oil and Gas Journal, p. 62, Aug. 16, 1971.
The Oil and Gas Journal, p. 78, Mar. 15, 1971.

*Primary Examiner*—Curtis R. Davis
*Attorney, Agent, or Firm*—Frishauf, Holtz, Goodman & Woodward

[57] ABSTRACT

A process for producing aromatic hydrocarbons in a high yield by introducing a naphtha fraction the cyclopentane content of which is controlled to not more than 1% by weight, or the methylpentane content is controlled to not more than 10% by weight, in a catalytic reaction tower, and contacting with a catalyst comprising a large pore zeolite containing at least one of Group VII metals of the Periodic Table. In this process, the catalyst cycle is greatly lengthened.

17 Claims, 2 Drawing Sheets

PROCESS FOR PRODUCTION OF AROMATIC HYDROCARBONS

This application is a Continuation-In-Part of application Ser. No. 07/214,522, filed July 1, 1988, now abandoned.

BACKGROUND THE INVENTION

1. Field of the Invention

The present invention relates to a process for production of aromatic hydrocarbons and more particularly to a process for producing aromatic hydrocarbons from a naphtha fraction efficiently over a long period of time.

2. Description of Related Art

For petrochemical production of aromatic hydrocarbons such as benzene, toluene, xylene and the like, a method for catalytic reforming of a naphtha fraction with a strong acid zeolite catalyst, e.g., ZSM-5 has been known (see, for example, Japanese Patent Publication Nos. 42639/1981, 23368/1983, Japanese Patent Application Laid-Open Nos. 92717/1978, 140934/1981).

This method, however, has disadvantages in that cracked gases are formed in a large amount and therefore the yield of aromatic hydrocarbons is low.

In order to overcome the above problems, a method using a zeolite L catalyst with platinum deposited thereon has been proposed (see, for example, Japanese Patent Application Laid-Open No. 80333/1984). Although this method has an advantage that aromatic hydrocarbons can be produced with high selectivity, it suffers from problems that the catalytic activity is rapidly reduced and the catalyst cycle is short. To lengthen the catalyst cycle, it is necessary to maintain the yield of aromatic hydrocarbons at a low level such as below 50%.

In order to overcome the above prior art problems, the present inventors have made extensive investigations from various view points.

As a result, it has been found that cyclopentane or methylpentane contained in a naphtha fraction feed is responsible for the deposition of a large amount of coke becoming a catalyst poison for zeolite catalysts with large pore radius such as L-zeolite containing Group VIII metals of the Periodic Table, such as platinum and the like, and thus markedly shortens the catalyst cycle. Based on the findings, it has been found that if the cyclopentane content of the naphtha fraction feed is controlled to not more than 1% by weight or the methylpentane content is controlled to not more than 10% by weight by distillating the naphtha fraction feed or separation of high purity normal paraffins, the catalyst cycle (catalyst life) can be lengthened and aromatic hydrocarbons can be produced efficiently.

SUMMARY OF THE INVENTION

One object of the present invention is to provide a process for efficiently producing aromatic hydrocarbons from a naphtha fraction with high selectivity.

Another object of the present invention is to provide a process for producing aromatic hydrocarbons in which the catalyst life is lengthened.

The present invention relates to a process for producing aromatic hydrocarbons by contacting a naphtha fraction with a catalyst comprising a large pore zeolite containing at least one of Group VIII metals of the Periodic Table, which process is characterized in that &he cyclopentane content of the naphtha fraction to be introduced in a catalytic reactor is controlled to not more than 1% by weight, or the methylpentane content is controlled to not more than 10% by weight. In the specification, the large pore zeolite means zeolite having large pores with diameter in the range of 7 to 9 Å.

DESCRIPTION OF PREFERRED EMBODIMENTS

Figure 1:
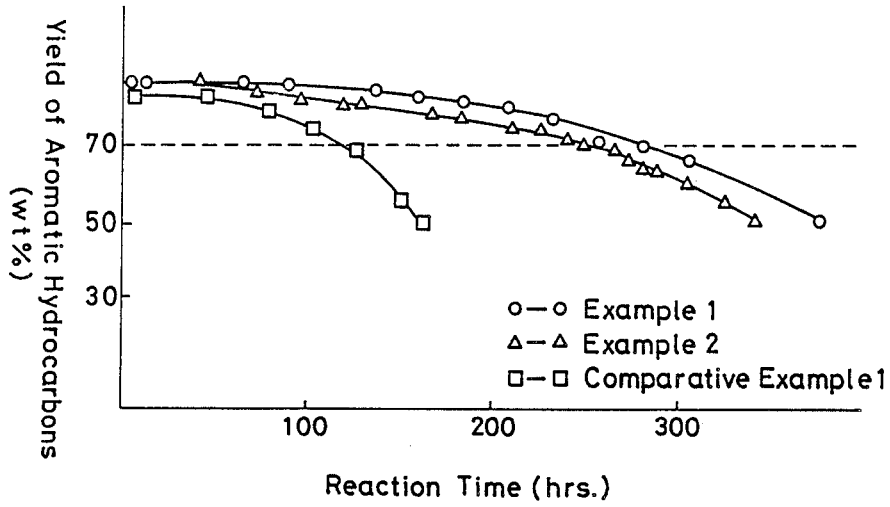
FIGS. 1 to 4 are graphs showing a relation between a reaction time of catalytic reforming and a yield of aromatic hydrocarbons in Examples and Comparative Examples.

The naphtha fraction to be used as the feed in the present invention may be a full range naphtha, i.e., a hydrocarbon mixture having 4 to 10 carbon atoms. In general, it is a hydrocarbon mixture having 4 to 7 carbon atoms, called a light naphtha, or a mixture containing a small amount of hydrocarbons having 8 carbon atoms. More specifically, a mixture of i-pentane, n-pentane, cyclopentane, 2,2-dimethylbutane, 2,3-dimethylbutane, 2-methylpentane, 3-methylpentane, n-hexane, methylcyclopentane, benzene, n-heptane and the like is used.

In accordance with the process of the present invention, the above naphtha fraction feed is contacted with a catalyst comprising a large pore zeolite containing at least one of Group VIII metals of the Periodic Table to produce aromatic hydrocarbons. In the practice of the process of the present invention, it is necessary that the cyclopentane content of the naphtha fraction feed be controlled to not more than 1% by weight, or the methylpentane content be controlled to not more than 10% by weight, preferably not more than 5% by weight and more preferably not more than 2% by weight, prior to the catalytic reforming reaction.

In order to control the cyclopentane content of the naphtha fraction feed to not more than 1% by weight, it suffices that the naphtha fraction feed is distilled to separate it into a hydrocarbon fraction having 5 or less carbon atoms ($C_5^-$ - fraction) as a tower head oil (an overhead fraction) and a hydrocarbon fraction having 6 to or more carbon atoms ($C_6^+$ fraction) as a tower bottom oil. Since cyclopentane has a boiling point near those of 2,2-dimethylbutane and the like in the $C_6$ fraction and thus they are difficult to separate from each other, it is preferred that the number of stages of fractionator be increased, or the reflux ratio be increased.

The methylpentane content of the naphtha fraction feed can be easily controlled to not more than 10% by weight with, for example, (1) a method in which the naphtha fraction feed is contacted with a suitable adsorption separator (e.g., a molecular sieve) to selectively separate paraffins through adsorption, thereby removing methylpentane, or (2) a method comprising a step in which the naphtha fraction feed is distillated (distillation step) and a step in which the tower bottom oil obtained at the distillation step is contacted with a suitable adsorption separator to selectively separate paraffins through adsorption, thereby removing methylpentane (adsorption separation step). That is, in accordance with the method (2) above, the naphtha fraction feed is separated into a $C_5^-$ fraction as tower head oil and a $C_6^+$ fraction as the tower bottom oil through distillation at the distillation step, and the $C_6^+$ thus obtained is introduced in the adsorption separation step where paraffins are selectively separated through adsorption with a suitable adsorption separator (e.g., a molecular sieve) to thereby control the methylpentane content of the naphtha fraction feed to be fed to the catalytic reactor to not more than 10% by weight. The reaction at the adsorption separation step can be carried out under conditions commonly employed in the usual adsorption separation, for example, at a temperature of 200° to 300° C. under a pressure of 10 to 40 kg/cm$^2$G. The order in which the distillation step and the adsorption separation step are carried out is not critical, and the adsorption separation step may be provided before the distillation step.

The naphtha fraction feed thus obtained, having a cyclopentane content of not more than 1% by weight or a methylpentane content of not more than 10%.by weight, preferably not more than 5% by weight and more preferably not more than 2% by weight, and particularly preferably having a methylpentane content of not more than 10% by weight and a cyclopentane content of not more than 1% by weight at the same time is introduced in the catalytic reactor where it is subjected to catalytic reforming.

The catalyst to be used in the process of the present invention is a large pore zeolite containing at least one of Group VIII metals of the Periodic Table. This large pore zeolite includes zeolite X, zeolite Y, zeolite L and the like. Of these, zeolite L is preferred.

This zeolite L is represented by the composition formula:

$$0.9 - 1.3\ M_{2/n}O \cdot Al_2O_3 \cdot 5.0 - 7.0\ SiO_2 \cdot 0 - 9\ H_2O$$

(wherein M indicates an alkali metal or an alkaline earth metal, and n indicates the atomic valency of M). More specifically, the zeolites described in Japanese Patent Application Laid-Open Nos. 133835/1983 (p. 9 to 10) and 80333/1984 (p. 5) can be used.

The catalyst to be used in the present invention is a large pore zeolite, such as zeolite L and the like, with at least one of Group VIII metals, such as platinum, iron, cobalt, nickel and the like, deposited thereon. Particularly preferred is a large pore zeolite with platinum deposited thereon.

The amount of at least one of Group VIII metals being deposited is not critical. It is usually 0.1 to 5.0% by weight, preferably 0.3 to 1.5% by weight based on the total weight of the catalyst.

Deposition of metals such as platinum and the like on a giant fine pore zeolite such as zeolite L and the like can be carried out by various methods such as the vacuum impregnation method, the ordinary pressure impregnation method, the dipping method, and the ion exchange method. As a platinum source when platinum is used as the metal to be deposited, various compounds, specifically platinum ammine chloride, chloroplatinic acid, chloroplatinic acid salts, platinum tetraammine hydroxide, platinum dinitrodiammine and the like can be used.

The large pore zeolite catalyst of the present invention preferably is also treated with fluorine which is preferably applied by treating the L-type zeolite with a fluorocarbon. The conditions of treatment are not critical. The treatment may be carried out by contacting the L-type zeolite with a fluorocarbon at a temperature of 80° C. for a suitable period of time, for example 1 minute to 10 hours, preferably 0.5 to 3 hours. When the fluorocarbon is in gaseous form, the L-type zeolite is exposed to an atmosphere of the gaseous fluorocarbon under the aforenoted conditions. Typical examples of suitable fluorocarbons are trichloromonofluoromethane ($CFCl_3$) dichlorodifluoromethane ($CF_2Cl_2$), monochlorotrifluoromethane ($CF_3Cl$), dichloromonofluoromethane ($CHFCl_2$), monochlorodifluoromethane ($CHF_2Cl$), trifluoromethane ($CHF_3$), tetrafluoromethane ($CF_4$), 1,1,2-trichloro-1,2,2-trifluoroethane ($CF_2ClCFCl_2$) and 1,2-dichloro-1,1,2,2tetrafluoroethane ($CF_2ClCF_2Cl$).

In accordance with the process of the present invention, the naphtha fraction (preferably the $C_6$+ fraction) as obtained above is introduced in a catalytic reactor charged with the above metal-deposited zeolite catalyst as a dehydrogenation cyclization catalyst and contacted with the catalyst under high temperature and high pressure conditions in the presence of hydrogen to produce aromatic hydrocarbons and hydrogen through the catalytic reforming reaction. In this reaction, the temperature is 350 to 600° C. and preferably 400° to 550° C., the pressure is 0 to 40 kg/cm2G and preferably 0 to 10 kg/cm2G, and the liquid hourly space velocity (LHSV) is 0.1 to 20 hr-1 and preferably 1 to 10 hr$^{-1}$. Much better results can be expected when the ratio of hydrogen gas to the naphtha fraction feed, i.e., hydrogen/naphtha fraction feed ratio, is controlled to 1:1 to 50:1 (by mole) and preferably 2:1 to 10:1 (by mole).

Although the reaction can be performed outside the above specified reaction conditions, problems sometimes occur in that aromatic hydrocarbons cannot be produced in the desired yield and the catalytic activity abruptly drops.

As described above, the process of the present invention enables one to produce aromatic hydrocarbons from a naphtha fraction feed with high selectivity. Further, since the catalyst cycle (catalyst life) is markedly lengthened, the number of regeneration of the catalyst can be decreased. As a result, the operation can be carried out continuously for a long period of time, which is greatly advantageous from an economic standpoint.

Accordingly the process of the present invention is of the high practical value as a process for efficient production of aromatic hydrocarbons which are useful as starting materials for various products, or solvents and the like in the petrochemical industry.

The present invention is described in further detail with reference to the following examples.

EXAMPLES 1 TO 4 AND COMPARATIVE EXAMPLES 1 AND 2

A full range naphtha was distilled to obtain a feed oil having the composition shown in Table 1.

The fluorocarbon-treated zeolite L with 0.5% by weight of platinum deposited thereon used as a catalyst was prepared as follows:

15 grams of synthetic L-type zeolite was packed in a tubular reactor having a diameter of 20 millimeters. The zeolite was maintained at 500° C. for 1 hour while flowing nitrogen in contact with the zeolite in the reactor. Then the gas was changed from nitrogen to monochlorotrifluoromethane ($CF_3Cl$) at 300° C., and the zeolite was maintained at 300° C. for 2 hours in an atmosphere of the $CF_3Cl$ gas. Then the gas was again changed to nitrogen and the temperature was lowered to room temperature.

Tetraammineplatinum chloride ($Pt(NH_3)_4Cl_2$) in the amount of 0.5 wt. % (as platinum) based on the weight of the above fluorocarbon-treated L-type zeolite was dissolved in deionized water of the amount corresponding to the saturated water content of the zeolite to thereby impregnate the zeolite with platinum. After deposition, the zeolite was dried at 80° C. for 3 hours in a hot air drier, pelletized by molding under pressure by the use of a molding machine, pulverized in a mortar, and sieved to 16–32 mesh.

The catalyst was previously subjected to pre-treatment for 24 hours at 540° C. under reduced pressure in a stream of hydrogen.

A catalytic reactor was charged with 0.5 g of the catalyst subjected to the above pre-treatment, and the above feed oil was introduced in the catalytic reaction tower to cause the catalytic reaction. This reaction was carried out continuously under conditions of temperature 500° C., pressure 5 kg/cm2G, liquid hourly space velocity 2 $hr^{-1}$, hydrogen/feed oil ratio (by mole) 5.

Figure 2:
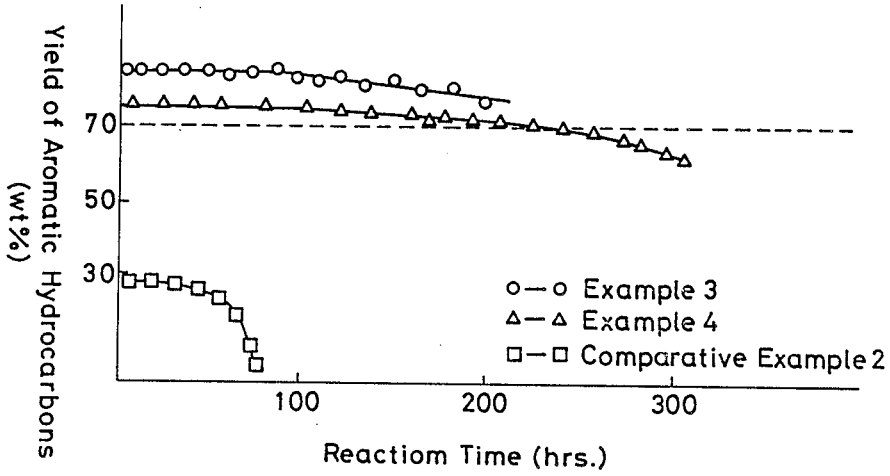

A relation between the reaction time and the yield of aromatic hydrocarbons is shown in FIG. 1 (Examples 1, 2, and Comparative Example 1) and FIG. 2 (Examples 3, 4 and Comparative Example 2).

It can be seen from FIGS. 1 and 2 that when the cyclopentane content of the naphtha fraction feed is not more than 1% by weight, the catalyst cycle can be greatly lengthened.

EXAMPLE 5

A desulfurized light naphtha fraction was subjected to adsorption separation treatment by contacting with a molecular sieve (an adsorption separator) to obtain a feed oil having the composition shown in Table 2.

This feed oil was introduced in a fixed bed reactor charged with 0.5 g of a fluorocarbon-treated zeolite L catalyst with 0.5% by weight of platinum deposited thereon, and was subjected to the catalytic reforming reaction under conditions of temperature 500° C., pressure 5kg/$cm^2$G, LHSV 2 $hr^{-1}$, hydrogen gas/feed oil ratio (by mole) 5.

Figure 3:
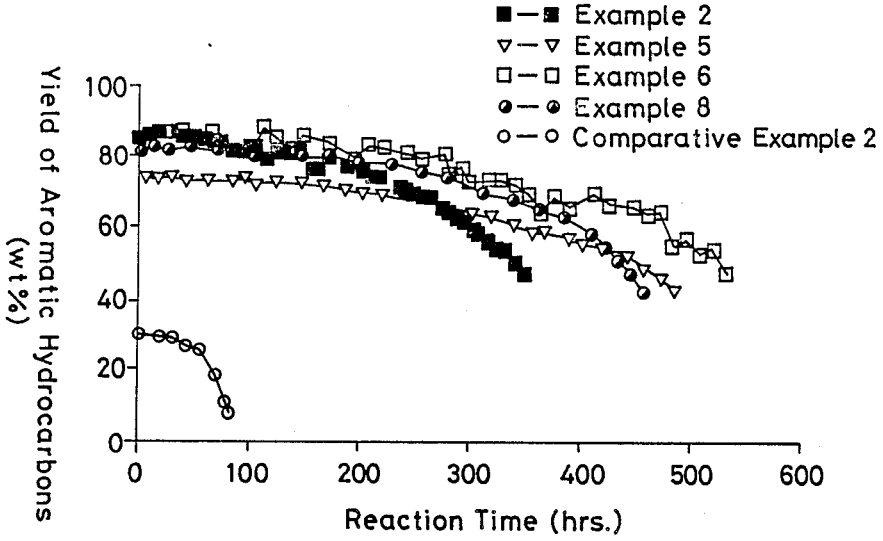

A relation between the reaction time and the yield of aromatic hydrocarbons is shown in FIG. 3.

EXAMPLE 6

The same desulfurized light naphtha fraction as used in Example 5 was introduced in a distillation tower where it was distilled. The tower bottom oil ($C_6$+ thus obtained was subjected to the adsorption separation treatment under the same conditions as in Example 5 to obtain a feed oil having the composition shown in Table 2.

The feed oil thus obtained was subjected to the catalytic reforming reaction under the same conditions as in Example 5.

A relation between the reaction time and the yield of aromatic hydrocarbons is shown in FIG. 3.

It can be seen from FIG. 3 that when the methylpentane content of the feed oil to be introduced in the catalytic reactor is not more than 10% by weight, the yield of aromatic hydrocarbons is high and the catalyst cycle is greatly lengthened.

EXAMPLE 7

The catalytic reforming reaction was carried out under the same conditions as in Example 6 except that the pressure was changed from 5 kg/$cm^2$G to 0 kg/$cm^2$G.

Figure 4:
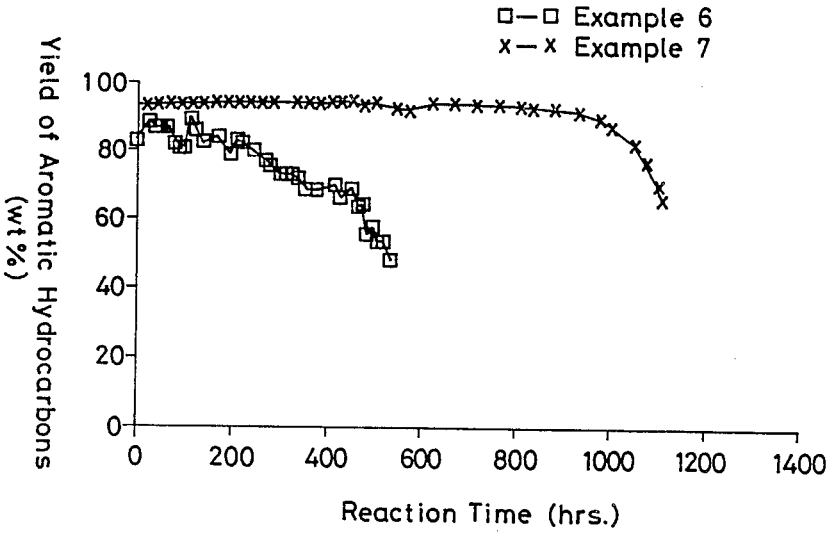

A relation between the reaction time and the yield of aromatic hydrocarbons is shown in FIG. 4 along with that of Example 6.

It can be seen from FIG. 4 that when the reaction pressure is decreased in the catalytic reforming reaction of the feed oil having the composition as controlled according to the present invention, the catalyst life is further lengthened.

EXAMPLE 8

A desulfurized light naphtha fraction was subjected to the adsorption separation treatment under milder conditions than in Example 5 to obtain a feed oil having the composition shown in Table 2.

The feed oil thus obtained was subjected to the catalytic reforming reaction under the same conditions as in Example 5.

A relation between the reaction time and the yield of aromatic hydrocarbons is shown in FIG. 3.

TABLE 1

| | (Feed Oil Composition (wt %)) | | | | | |
|---|---|---|---|---|---|---|
| | Example 1 | Example 2 | Comparative Example 1 | Example 3 | Example 4 | Comparative Example 2 |
| $C_4$ Fraction | — | — | — | — | 1.4 | 0.5 |
| $C_5$ Fraction | — | — | — | 0.8 | 13.5 | 62.1 |
| Cyclopentane | — | — | 2.1 | 0.7 | 0.6 | 2.5 |
| Dimethylbutane | 3.3 | 2.6 | 3.2 | 2.3 | 0.8 | 1.9 |
| 2-Methylpentane | — | 23.3 | 22.6 | 23.5 | 5.6 | 11.3 |
| 3-Methylpentane | 39.7 | 16.7 | 16.2 | 15.0 | 4.8 | 5.6 |
| n-Hexane | 49.0 | 49.3 | 48.0 | 40.4 | 6.7 | 11.5 |
| Methylcyclopentane | 8.0 | 8.1 | 7.9 | 8.6 | 5.0 | 2.3 |
| Benzene | — | — | — | 5.9 | 1.9 | 1.7 |
| $C_7$+ Fraction | — | — | — | 2.8 | 49.3 | 0.6 |

TABLE 2

| | (Feed Oil Composition (wt %)) | | | |
|---|---|---|---|---|
| | Example 5 | Example 6 | Example 7 | Example 8 |
| $C_4$ Fraction | 0.9 | — | — | 1.4 |
| $C_5$ Fraction | 19.4 | — | — | 13.5 |
| Cyclopentane | — | — | — | 0.6 |
| Dimethylbutane | — | — | — | 0.8 |
| 2-Methylpentane | 0.5 | 0.6 | 0.6 | 4.5 |
| 3-Methylpentane | 0.7 | 0.8 | 0.8 | 3.8 |
| n-Hexane | 53.1 | 97.6 | 97.6 | 19.2 |
| Methylcyclopentane | 0.9 | 1.0 | 1.0 | 5.0 |
| Benzene | — | — | — | 1.9 |
| $C_7$+ Fraction | 24.5 | — | — | 49.3 |

What is claimed is:

1. An improved catalytic process for producing aromatic hydrocarbons having increased catalyst life comprising contacting a naphtha fraction with a catalyst comprising a large pore zeolite containing at least one Group VIII metal of the Periodic Table, the improvement comprising contacting said catalyst with a naphtha fraction containing cyclopentane and methylpentane, at least one of said (i) cyclopentane being in an amount not more than 1% by weight and (ii) methylpentane being in an amount not more than 10% by weight.

2. The process as claimed in claim 1-wherein the methylpentane content of said naphtha fraction is not more than 5% by weight.

3. The process as claimed in claim 1 wherein the methylpentane content of the naphtha fraction is not more than 2% by weight.

4. The process as claimed in claim 1 wherein the large pore zeolite is a zeolite L.

5. The process as claimed in claim 1 wherein the large pore zeolite containing at least one of Group VIII metals of the Periodic Table is a zeolite L with platinum deposited thereon.

6. The process as claimed in claim 1 wherein the large pore zeolite containing at least one of Group VIII metal of the Periodic Table is a platinum deposited zeolite L subjected to fluorocarbon treatment.

7. The process as claimed in claim 1 wherein said naphtha fraction which is contacted with said catalyst contains cyclopentane in an amount not more than 1% by weight and methylpentane in an amount not more than 10% by weight.

8. The process as claimed in claim 5 wherein said naphtha fraction which is contacted with said catalyst contains cyclopentane in an amount not more than 1% by weight and methylpentane in an amount not more than 10% by weight.

9. A catalytic process for producing aromatic hydrocarbons having long catalyst life comprising providing a naphtha fraction containing cyclopentane in an amount more than 1% by weight and methylpentane in an amount more than 10% by weight to provide a pretreated naphtha fraction;

removing from said naphtha fraction at least one of cyclopentane and methylpentane in an amount or amounts such that at least one of the (i) cyclopentane content is not more than 1% by weight and (ii) said methylpentane content is not more than 10% by weight to provide a pretreated naphtha fraction; and contacting said pretreated naphtha fraction from which said at least one of cyclopentane and methylpentane has been removed so that at least one of (a) said cyclopentane content is not more than 1% by weight and (b) said methylpentane content is not more than 10% by weight, with a catalyst comprising a large pore zeolite containing at least one Group VII metal of the Periodic Table.

10. The process as claimed in claim 9 wherein said naphtha feed is pretreated to lower the cyclopentane content to not more than 1% and the methylpentane content to not more than 10%.

11. The process as claimed in claim 11 wherein said methylpentane content is lowered to not more than 5%.

12. The process as claimed in claim 10 wherein said methylpentane content is lowered to not more than 2%.

13. The process as claimed in claim 12 wherein the large pore zeolite is a zeolite L.

14. The process as claimed in claim 13 wherein the large pore zeolite containing at least one Group VIII metal of the Periodic Table is a zeolite L with platinum deposited thereon.

15. THe process as claimed in claim 14 wherein the large pore zeolite containing at least one Group VIII metal of the Periodic Table is a platinum deposited zeolite L subjected to fluorocarbon treatment.

16. The process as claimed in claim 9 wherein said catalyst is a zeolite catalyst having platinum deposited thereon.

17. The process as claimed in claim 16 wherein said zeolite catalyst is zeolite L.

* * * * *